United States Patent [19]

Andis

[11] 4,383,366

[45] May 17, 1983

[54] BLADE DRIVING ASSEMBLY FOR HAIR CLIPPER

[75] Inventor: Matthew L. Andis, Racine, Wis.

[73] Assignee: Andis Company, Racine, Wis.

[21] Appl. No.: 198,708

[22] Filed: Oct. 20, 1980

[51] Int. Cl.[3] ..... B26B 19/28

[52] U.S. Cl. ..... 30/221; 30/217

[58] Field of Search ..... 30/216, 218, 219, 220, 30/221, 222, 223, 217

[56] References Cited

U.S. PATENT DOCUMENTS

| | | | |
|---|---|---|---|
| 1,834,737 | 12/1931 | Redfield | 30/221 |
| 2,182,597 | 12/1939 | Oster | 30/196 |
| 2,790,236 | 4/1957 | Andis | 30/210 |
| 3,735,488 | 5/1973 | Reynolds | 30/221 |
| 3,992,778 | 11/1976 | Urbush | 30/216 |

*Primary Examiner*—Jimmy C. Peters

*Attorney, Agent, or Firm*—Michael, Best & Friedrich

[57] ABSTRACT

A cutting blade drive assembly for a hair clipper comprises a frame and a driven assembly rotatable on the frame about an axis fixed relative to the frame. The driven assembly includes a tension spring, and a cutting blade is engaged by the tension spring for reciprocal movement in response to oscillation of the drive assembly. The driven assembly also includes a mechanism for adjusting the tension in the tension spring. A drive unit on the frame operatively connects the driven assembly with an electric motor, which can also be supported on the frame, for oscillating the driven assembly about the axis to impart reciprocative movement to the cutting blade engaged by the driven assembly. The cutting blade drive assembly can be removably supported as an integral unit in the housing of a hair clipper so that the entire drive assembly may be readily removed from the housing for repair or replacement.

13 Claims, 3 Drawing Figures

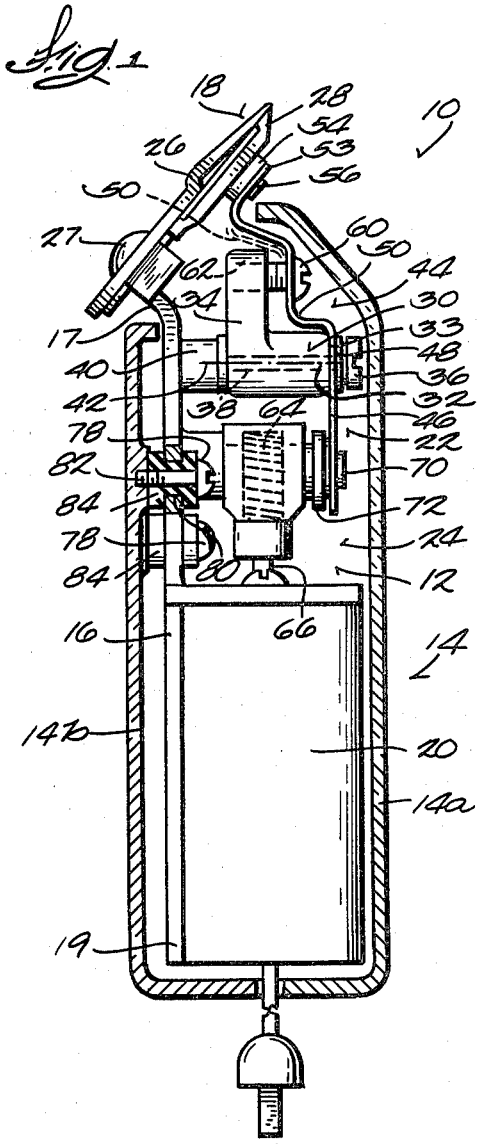
Fig. 1
18
28
54
53
56
26
10
50
27
60
50
44
62
34
30
33
17
48
40
36
42
32
38
64
46
78
22
82
70
84
72
78
24
84
80
12
66
16
14
14b
20
14a
19
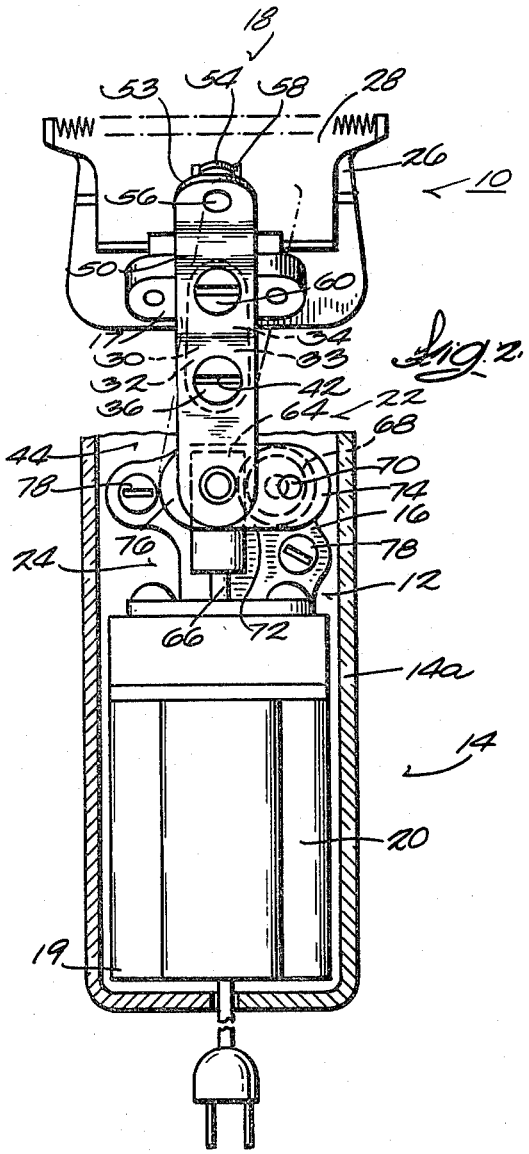
18
53
54
58
28
26
10
56
50
60
17
34
30
33
32
42
36
64
22
68
44
70
78
74
16
76
78
24
12
66
72
14a
14
20
19
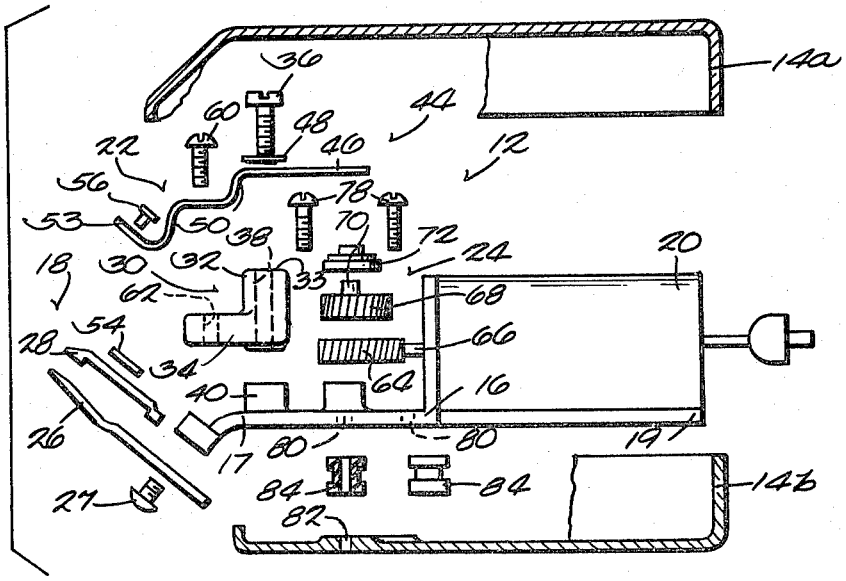
Fig. 3
36
14a
60
48
44
22
46
12
10
56
78
53
50
38
70
72
24
20
18
30
32
33
62
68
28
54
34
66
64
40
16
26
17
80
80
19
27
84
84
14b
82

BLADE DRIVING ASSEMBLY FOR HAIR CLIPPER

FIELD OF THE INVENTION

The invention generally relates to hair clippers. More particularly, the invention relates to cutting blade driving assemblies for hair clippers.

DESCRIPTION OF THE PRIOR ART

Attention is directed to the following U.S. patents which generally disclose blade sets and associated drive assemblies adapted for use with electrically operated hair clippers: Oster, U.S. Pat. No. 1,956,042, Apr. 24, 1934; Oster, U.S. Pat. No. 2,182,597, Dec. 5, 1939; Andis, U.S. Pat. No. 2,704,887, Mar. 29, 1955; Andis, U.S. Pat. No. 2,790,236, Apr. 30, 1957; Andis, U.S. Pat. No. 3,101,535, Aug. 27, 1963; Luther, et al, U.S. Pat. No. 3,222,781, Dec. 14, 1975; Urbush, U.S. Pat. No. 3,992,778, Nov. 23, 1976.

Attention is also directed to the Model A-5 clipper manufactured by the Oster corporation, Milwaukee, Wis., as well as to the "Outliner" model hair clipper manufactured by the Andis Clipper Co., Racine, Wis.

Attention is also directed to this inventor's now pending patent applications, Ser. No. 916,511, filed June 19, 1978, (entitled "Hair Clipper") and Ser. No. 096,784, filed Nov. 23, 1979 (entitled "Laminated Hair Clipper Blade Set").

SUMMARY OF THE INVENTION

The invention provides a drive assembly for operatively connecting a cutting blade with an electric motor. The drive assembly comprises a frame and a driven assembly which is rotatable on the frame about an axis fixed relative to the frame and which includes a tension spring. Means is provided on the tension spring for engaging the cutting blade to affect reciprocal movement of the cutting blade in response to oscillation of the driven assembly about the axis. The drive assembly further includes drive means which is also supported on the frame and which operatively connects the driven assembly with the electric motor. In particular, the drive means oscillates the driven assembly about the axis to thereby impart reciprocative movement to the cutting blade engaged by tension spring.

In one embodiment, the driven assembly includes means for adjusting the tension in the tension spring.

In one embodiment, the frame includes an end portion, and means is provided for supporting a second cutting blade on the frame end portion. In this embodiment, the first mentioned cutting blade engaged by the tension spring moves in a reciprocal path across the second cutting blade.

The invention also provides a hair clipper comprising a housing and a cutting blade drive assembly as described above, except that the electric motor is itself also supported on the frame. The cutting blade drive assembly is removably supported in the housing to facilitate repair and replacement of the component parts of the drive assembly, if required.

In one embodiment, the cutting blade drive assembly is resiliently supported in the housing to reduce overall vibration transmitted to the hands of the operator during cutting operations and to reduce noise.

One of the principal features of the invention is the provision of a hair clipper having a cutting blade drive assembly which is supported as a unit on a single frame and which may thus be readily removed as a unit for repair and replacement.

Other features and advantages of the embodiments of the invention will become known by reference to the following description, the drawings, and appended claims.

BRIEF DESCRIPTION OF THE DRAWINGS

FIG. 1 is a side view, with parts broken away and in section, of a hair clipper which includes a cutting blade assembly embodying various of the features of the invention;

FIG. 2 is a top view of the hair clipper shown in FIG. 1 and with a part broken away and in section; and FIG. 3 is an exploded view of the hair clipper shown in FIG. 1.

Before explaining the embodiments of the invention in detail, it is to be understood that the invention is not limited in its application to the details of construction and the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

GENERAL DESCRIPTION

Shown in the drawings is a hair clipper 10 which embodies various features of the invention. Generally, the clipper 10 includes a cutting blade drive assembly 12 which is removably mounted in a housing 14 or case. As is best shown in FIG. 3, the housing 14 is of molded, two piece construction, preferably plastic, having an upper housing section **14*a* and a lower housing section 14*b*. The housing sections 14*a* and 14*b*** are assembled together, such as with screws (not shown).

The drive assembly 12 (see, in particular, FIG. 3) includes a frame 16 which is preferably fabricated of diecast metal or plastic. A blade set 18 and an electric motor 20 are supported at opposite ends, respectively 17 and 19, of the frame 16. Also supported on the frame 16 are driven assembly 22 and drive means 24 which together operatively connect the motor 20 with the blade set 18.

In the illustrated embodiment, the blade set 18 includes a fixed blade 26, or shear plate, and a blade 28 which is movable against and relative to the fixed blade 26. The particular operative interface between the movable blade 28 and the fixed blade 26 may vary and does not affect the applicability of the invention herein described.

The fixed blade 26 is attached, such as by screws 27 (only one is shown in FIGS. 1 and 3), to the exposed end 17 of the frame 16. The movable blade 28 is engaged by the driven assembly 22 which is, in turn, operatively connected with the motor 20 by the drive means 24 to impart reciprocative movement of the movable blade 28 relative to the fixed blade 26. During this reciprocative movement, the teeth of the movable blade 28 cooperate with the teeth of the fixed blade 26 to cut hair.

While various constructions are possible, in the illustrated construction, the driven assembly 22 includes a pivot block 30 having a main body 32 and a shoulder 34 which extends radially outwardly from the main body 32. The shoulder 34 is stepped below the top surface 33 of the main body 32.

A screw 36 extends through an internally non-threaded bore 38 in the main body 32 of the pivot block 30 and connects the pivot block 30 to an internally threaded bushing 40 which is integrally attached, such as by gluing or welding, to the frame 16. The pivot block 30 can thus rotate on the frame 16 about the longitudinal axis 42 (see FIG. 1).

The driven assembly 22 further includes a drive arm 44 which includes a first portion 46 which is operatively connected with the main body 32 of the pivot block 30 by means of the screw 36 and a spring washer 48. The drive arm 44 also includes a second portion 50 radially extending from the first portion 46 and axially overhanging the shoulder 34. This second portion 50 is bent to form a tension spring (as is best shown in FIGS. 1 and 3).

The movable blade 28 is engaged by the tension spring end 53 of the drive arm 44 against the fixed blade 26 subject to the tension in the tension spring 50. While various constructions are possible, in the illustrated embodiment, the end 53 of the tension spring 50 carries a driving collar 54 or roller, which preferably takes the form of a plastic bead internally screw-threaded to receive a screw 56 which passes through the end 53 to secure the bead 54 thereto. The bead 54 is engaged within a slot 58 (see FIG. 2) which is centrally located on the movable blade 28.

In the illustrated construction, the driven assembly 22 also includes tension spring adjusting means which in the illustrated embodiment takes the form of a screw 60 which extends through the tension spring 50 of the drive arm 44 and is operatively threaded within a bore 62 in the pivot block shoulder 34. As is shown in phantom lines in FIG. 1, rotation of the screw 60 pivots the tension spring 50 relative to the portion 46 of the drive arm 44 in a path axially of the rotational axis 42 of the pivot block 30. The tension transmitted by the tension spring 50 to the movable blade 28 can thus be adjusted.

The drive means 24 may be variously constructed. In the illustrated embodiment, the drive means 24 includes a pinion gear 64 coupled to the drive shaft 66 of the motor 20. The pinion gear 64, in turn, is coupled to a worm gear 68 which includes an eccentric pin 70. A pivot arm 72 (as best shown in FIG. 2) is pivotally connected at one end 74 to the eccentric pin 70 and at the other end 76 is pivotally connected to the first portion 46 of the drive arm 44. By virtue of this connection, and as shown in phantom lines in FIG. 2, rotation of the worm gear 68 in response to pinion gear rotation oscillates the drive arm 44 and pivot block 30 about axis 42 to impart reciprocative to the movable blade 28.

As is shown in FIG. 3, the entire cutting blade drive assembly 12 is removably supported in the housing of the hair clipper 10 by means of support screws 78 (see also FIG. 1) which pass through bores 80 in the frame 16 and into internally-threaded bores 82 (only one is shown) formed in the interior of the clipper housing 14. The entire cutting blade drive assembly 12 may thus be removed from the housing 14, should repair or replacement of all or any of the component parts be desired.

Also in the illustrated embodiment, resilient mounting gaskets 84, preferably rubber, are utilized to resiliently support the entire cutting blade drive assembly 12 in the housing. This minimizes vibration occasioned by motor operation and reduces noise.

Various of the features of the invention are set forth in the following claims.

I claim:

1. A drive assembly for operatively connecting a cutting blade with an electric motor having a rotatable output shaft, said drive assembly comprising a frame, a driven assembly rotatable on said frame about a first axis fixed relative to said frame and including a tension spring and means on said tension spring for engaging the cutting blade to effect reciprocal movement of the cutting blade in response to oscillation of said driven assembly about said axis, and drive means including a component supported by said frame for rotation about a second axis fixed relative to said frame in spaced relation to said first axis and operatively connected between said driven assembly and said output shaft for oscillating said driven assembly about said first axis to impart reciprocal movement to said cutting blade engaged by said tension spring in response to rotation of said output shaft.

2. A drive assembly according to claim 1 and wherein said driven assembly includes means for adjusting the tension in said tension spring.

3. A drive assembly according to claim 1 or 2 wherein said frame includes an end portion, and further including means for supporting a second cutting blade on said frame end portion, and wherein said blade engaging means on said driven assembly includes means engaging the cutting blade for reciprocal movement relative to the cutting blade on said frame end portion.

4. A drive assembly for operatively connecting a cutting blade with an electric motor, said drive assembly comprising a frame, a block rotatable on said frame about an axis fixed relative to said frame, and an arm operatively connected with said block for common movement therewith and including a first portion and a second portion oppositely and radially spaced relative to said axis from said first portion and including a tension spring and a terminal end engaging said cutting blade to effect reciprocal movement of said cutting blade in response to oscillation of said block about said axis, and drive means on said frame operatively connecting said block with said electric motor for oscillating said block about said axis to impart reciprocal movement to said cutting blade engaged by said tension spring.

5. A drive assembly according to claim 4 wherein said block includes a main body having a top surface and a shoulder extending radially from said body below said top surface thereof, wherein said arm first portion is operatively connected with said main body top surface, wherein said arm second portion extends from said arm first portion in a direction generally axially overhanging said shoulder, and wherein said tension spring adjusting means includes adjustable screw means connecting said arm second portion with said shoulder and operative for pivoting said arm second portion relative to said arm first portion and axially of said axis.

6. A drive assembly according to claim 4 and further including means for adjusting the tension in said tension spring.

7. A hair clipper comprising a housing, a cutting blade drive assembly including a frame having an end portion, a first cutting blade supported on said frame end portion, a second cutting blade, a driven assembly rotatable on said frame about a first axis fixed relative to said frame and including a tension spring and means on said tension spring for engaging said second cutting blade to effect reciprocative movement of said second cutting blade relative to said first cutting blade in response to oscillation of said driven assembly about said first axis, an electric motor supported on said frame and including a rotatable output shaft, and drive means including a component supported by said frame for rotation about a second axis fixed relative to said frame in spaced relation to said first axis and operatively connected between said driven assembly and said output shaft for oscillating said driven assembly about said first axis to impart reciprocative movement to said second cutting blade relative to said first cutting blade in response to rotation of said output shaft, and means for removably supporting said cutting blade drive assembly in said housing with said first and second cutting blades extending outwardly from said housing.

8. A hair clipper according to claim 7 and wherein said cutting blade drive assembly support means includes means for resiliently supporting said cutting blade drive assembly in said housing.

9. A hair clipper according to claim 7 or 8 and wherein said driven assembly of said cutting blade drive assembly includes means for adjusting the tension in said tension spring.

10. A hair clipper comprising a housing, a cutting blade drive assembly including a frame having an end portion, a first cutting blade supported on said frame end portion, a second cutting blade, a block rotatable on said frame about an axis fixed relative to said frame, and an arm operatively connected with said block for common movement therewith and including a first portion and a second portion operatively and radially spaced relative to said axis from said first portion and including a tension spring and a terminal end engaging said second cutting blade to effect reciprocative movement of said second cutting blade relative to said first cutting blade in response to oscillation of said block assembly about said axis, an electric motor supported on said frame, and drive means on said frame operatively connecting said block with said electric motor for oscillating said block about said axis to impart reciprocative movement to said second cutting blade relative to said first cutting blade, and means for removably supporting said cutting blade drive assembly on said housing with said first and second cutting blades extending outwardly from said housing, and wherein said second cutting blade is engaged by said terminal end of said arm second portion.

11. A hair clipper according to claim 10 wherein said block includes a main body having a top surface and a shoulder extending radially from said main body below said top surface thereof, wherein said arm first portion is operatively connected with said main body top surface, wherein said arm second portion extends from said arm first portion in a direction generally axially overhanging said shoulder, and wherein said tension spring adjusting means includes adjustable screw means connecting said arm second portion with second shoulder and operative for pivoting said arm second portion relative to said arm first portion and axially of said axis.

12. A hair clipper according to claim 10 and wherein said cutting blade drive assembly support means includes means for resiliently supporting said cutting blade drive assembly in said housing.

13. A hair clipper according to claim 10 or 12 and further including means for adjusting the tension in said tension spring.

* * * * *